US007879786B1

(12) United States Patent
Bai et al.

(10) Patent No.: US 7,879,786 B1
(45) Date of Patent: Feb. 1, 2011

(54) DETERGENT COMPOSITION

(75) Inventors: Yung-Hsiang Bai, Taoyuan Hsien (TW); Yu-Fen Liao, Taoyuan Hsien (TW); Yi-Jin Chen, Taoyuan Hsien (TW); Yen-Cheng Li, Taoyuan Hsien (TW)

(73) Assignee: Everlight USA, Inc., Pineville, NC (US)

( * ) Notice: Subject to any disclaimer, the term of this patent is extended or adjusted under 35 U.S.C. 154(b) by 0 days.

(21) Appl. No.: 12/805,900

(22) Filed: Aug. 24, 2010

(30) Foreign Application Priority Data

Sep. 3, 2009 (TW) ..... 98129677 A

(51) Int. Cl.
*C11D 1/16* (2006.01)
*C11D 1/70* (2006.01)
*C11D 1/83* (2006.01)
*C11D 3/04* (2006.01)

(52) U.S. Cl. ..... 510/182; 510/163; 510/166; 510/179; 510/424; 510/427; 510/434; 510/492; 510/506

(58) Field of Classification Search ..... 510/163, 510/166, 179, 182, 424, 427, 434, 492, 506
See application file for complete search history.

(56) References Cited

U.S. PATENT DOCUMENTS 5,002,686 A * 3/1991 Guth et al. ..... 510/339
H001467 H * 8/1995 Prieto et al. ..... 510/340
5,635,462 A * 6/1997 Fendler et al. ..... 510/131
6,767,881 B1 * 7/2004 Griese et al. ..... 510/421
6,846,793 B1 * 1/2005 Griese ..... 510/421
2007/0259802 A1 * 11/2007 Heintz et al. ..... 510/375

FOREIGN PATENT DOCUMENTS

JP 08-214321 8/1996
JP 2001181699(A) 7/2001

* cited by examiner

*Primary Examiner*—Gregory R Del Cotto
(74) *Attorney, Agent, or Firm*—Bacon & Thomas, PLLC

(57) ABSTRACT

A detergent composition is disclosed, which comprises:

(A) an alkali metal hydroxyl compound in an amount of 0.1 to 20 parts by weight;

(B) a nonionic surfactant represented by the following formula (I) in an amount of 0.1 to 30 parts by weight:

(I)

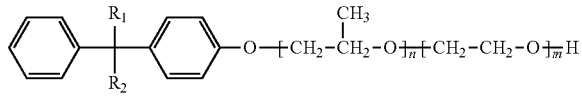

wherein $R_1$ is hydrogen or methyl; $R_2$ is hydrogen or methyl; n is an integer from 0 to 10; and m is an integer from 4 to 20;

(C) an anionic surfactant in an amount of 0.1 to 10 parts by weight;

(D) a chelating agent in an amount of 0.1 to 20 parts by weight;

(E) an additive in an amount of 0.1 to 20 parts by weight; and (F) water of remaining parts based on 100 parts by weight of the detergent composition.

6 Claims, No Drawings

DETERGENT COMPOSITION

BACKGROUND OF THE INVENTION

1. Field of the Invention

The present invention relates to a detergent composition used to clean surfaces of glass substrates and, more particularly, to a high to concentration detergent composition applied in the field of flat to panel displays.

2. Description of Related Art

In recent years, liquid crystal display televisions or plasma televisions are representative flat to panel displays. As maximization or miniaturization of panel dimensions progresses, requirements for cleanness of panel surfaces during the manufacturing process are more and more considerable. In common manufacturing of flat to panel displays, surface cleanness of glass substrates can influence the yield of the following processes. Accordingly, it will be a key point that cleanness of glass substrate surfaces is increased and stabilized by a detergent. Therefore, demands for adequately washing oil contamination or particles off substrate surfaces are more and more significant.

Detergent compositions developed currently are, for example, those disclosed in Japanese patent No. 7-305093 and in Japanese laid to open patent publication No. 2001-181699. However, considering that current detergents must have a high performance for cleaning glass substrates in a short period, the cleaning performance provided from those detergent compositions disclosed in the abovementioned references is still not acceptable.

Basic compounds applied in basic detergents are generally classified into two classes of inorganic and organic bases. Among common inorganic bases, NaOH, KOH, $Na_2CO_3$, and $NaHCO_3$ are exemplified. Among common organic bases, tetramethylammonium hydroxide or alkanolamines are exemplified. All aforesaid basic compounds are widely used in detergents.

Methods for cleaning glass substrates in common use are well to known cleaning methods and technologies such as ultrasonic cleaning, rotary cleaning, swing cleaning, brush cleaning, and so on.

In the current trend of basic detergents, in addition to basic compounds, surfactants are also used to enhance cleaning performance. At present, nonionic surfactants having excellent cleaning performance commonly used in industries are alkylene oxide to based surfactants. In addition to one single alkylene oxide to based surfactant, mixtures containing multiple alkylene oxide to based surfactants are also used to afford the most powerful cleaning performance. The mixtures may contains various moles and different kinds of alkylene oxides such as ethylene oxide and propylene oxide so as to give little formation of foam during operation, outstanding detergency and minimum surface remainder of the mixture, and so forth.

Generally, surface contamination of glass substrates easily affects coating of photoresists. As a result, photoresists has a bad attachment to the substrates or pattern manufacturing is influenced unsatisfactorily during development processes, leading to a decrease of the yield. Hence, there is an urgent need for a detergent composition capable of overcoming the problems mentioned above.

SUMMARY OF THE INVENTION

In the present invention, addition of a surfactant of the following formula (I) to a detergent composition can improve surface contamination of glass substrates and thus stable surface quality of glass substrates can be afforded, resulting in improvement of the process yield.

(I)

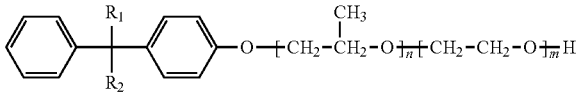

In the formula (I), wherein $R_1$ is hydrogen or methyl; $R_2$ is hydrogen or methyl; n is an integer from 0 to 10 and m is an integer from 4 to 20.

In order to overcome the aforesaid questions and achieve the abovementioned object, the present invention provides a detergent composition that is used to clean surfaces of glass substrates. The detergent composition contains: (A) an alkali metal hydroxyl compound, (B) a nonionic surfactant represented by the following formula (I), (C) an anionic surfactant, (D) a chelating agent, (E) an additive, and (F) water. The detergent composition can be used for surface cleaning of glass substrate and give little formation of foam during operation, outstanding detergency, minimum surface remainder, and so forth. The most important thing is that the detergent composition can improve surface cleanness of glass substrates.

The detergent composition of the present invention includes a nonionic surfactant represented by the following formula (I) used therein.

(I)

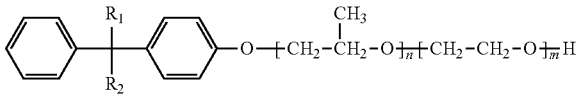

In the formula (I), wherein $R_1$ is hydrogen or methyl; $R_2$ is hydrogen or methyl; n is an integer from 0 to 10, and m is an integer from 4 to 20.

The alkali metal hydroxyl compound used in the detergent composition of the present invention, can be any commonly known basic compound. Among inorganic basic compounds, alkali metal hydroxyl compounds in which alkali metal is Li, K, Na, and so on, are preferable. More preferably, the alkali metal hydroxyl compound used is at least one selected from the group consisting of NaOH, KOH, and a combination thereof.

The anionic surfactant used in the detergent composition of the present invention, preferably is at least one selected from the group consisting of

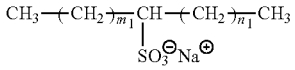

wherein $m_1$ and $n_1$ both are an integer, and $m_1+n_1$=10-14,

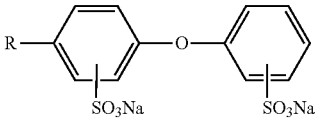

wherein R=$C_1$-$C_{12}$ alkyl group, and a combination thereof. In other words, the anionic surfactant used in the present invention preferably is at least one selected from the group consisting of secondary alkane sulfonates (SAS), disodium dodecyldiphenyl ether sulfonate, and a combination thereof.

The chelating agent used in the detergent composition of the present invention, can be ethylenediaminetetraacetatic acid (EDTA) or its salts but most preferably is its sodium salts such as disodium EDTA (EDTA-2Na) and tetrasodium EDTA (EDTA-4Na); can be nitrotriacetic acid (NTA) or its salts but most preferably is its sodium salts such as trisodium NTA (NTA-3Na); or can be others such as salt compounds containing two or more hydroxyl groups. Considering enhancing product stability and cleaning performance of the detergent composition, the additive used in the detergent composition of the present invention preferably is sodium p-toluenesulfonate, sodium xylenesulfonate, or a combination thereof since the detergent composition of the present invention contains a nonionic surfactant. Generally, when p-toluenesulfonate or sodium xylenesulfonate is incorporated in a detergent composition containing a nonionic surfactant, the incorporation of p-toluenesulfonate or sodium xylenesulfonate can raise a cloud point, increase water-solubility, and minimize remainders of the nonionic surfactant during operation of the detergent composition. Cleaning performance of the detergent composition is therefore improved. Most preferably, p-toluenesulfonate can be used.

Herein, the detergent composition related in the present invention is delineated in detail.

Based on 100 parts by weight in total of the detergent composition of the present invention, the basic compound is used preferably in an amount of 0.1 to 20 parts by weight. The detergent composition is in a pH range from 9 to 14.

Based on 100 parts by weight in total of the detergent composition of the present invention, the nonionic surfactant represented by the following formula (I) is used preferably in an amount of 0.1 to 30 parts by weight. If the amount of the nonionic surfactant is less than 0.1 parts by weight, the cleaning performance of the detergent composition is not adequate. However, if the amount of the nonionic surfactant is more than 30 parts by weight, it is easy that the solubility of the basic compound decreases and severe foaming occurs.

Based on 100 parts by weight in total of the detergent composition of the present invention, the anionic surfactant represented by the following formula (I) is used preferably in an amount of 0.1 to 10 parts by weight. If the amount of the anionic surfactant is less than 0.1 parts by weight, the cleaning performance of the detergent composition is not adequate. However, if the amount of the anionic surfactant is more than 10 parts by weight, it is easy that the solubility of the basic compound decreases and severe foaming occurs.

Based on 100 parts by weight in total of the detergent composition of the present invention, the chelating agent is used preferably in an amount of 0.1 to 20 parts by weight. If the amount of the chelating agent is less than 0.1 parts by weight, the cleaning performance of the detergent composition is not adequate. However, if the amount of the chelating agent is more than 20 parts by weight, it is easy that the solubility of the chelating agent decreases.

Based on 100 parts by weight in total of the detergent composition of the present invention, the additive is used preferably in an amount of 0.1 to 20 parts by weight. If the amount of the additive is less than 0.1 parts by weight, the performance of the detergent composition is not adequate. However, if the amount of the chelating agent is more than 20 parts by weight, it is counterproductive.

Based on 100 parts by weight in total of the detergent composition of the present invention, the remaining parts by weight are water in addition to the ingredients described above. The water is general use water such as pour water, deionized water, or distilled water.

The detergent composition of the present invention is a high-concentration detergent, and it can be diluted with pour water in 5-100 times the weight of the detergent composition generally in the production line if necessary.

BRIEF DESCRIPTION OF THE DRAWINGS

None.

DETAILED DESCRIPTION OF THE PREFERRED EMBODIMENT

Hereinafter, preferred embodiments are presented in detail to specifically illustrate the present invention, but they are not construed to limit the scope claimed in the present invention.

Formulation of a High-Concentration Detergent Composition

Example 1

In the present example, the alkali metal hydroxyl compound (KOH), the nonionic surfactant (CPE-212), the anionic surfactant (SAS60), the chelating agent (EDTA-4Na), and the additive (p-TsONa) were used in accordance with Table 1, and pure water was further added to form a high-concentration detergent composition in a total amount of 100 g.

Example 2

In the present example, the alkali metal hydroxyl compound (KOH), the nonionic surfactant (CPE-212), the anionic surfactant (SS—H), the chelating agent (EDTA-4Na), and the additive (p-TsONa) were used in accordance with Table 1, and pure water was further added to form a high-concentration detergent composition in a total amount of 100 g.

Comparative Example 1

In the present comparative example, all ingredients and their amounts were the same as those in Example 1 except the nonionic surfactant was not added.

Comparative Example 2

In the present comparative example, all ingredients and their amounts were the same as those in Example 2 except the nonionic surfactant was not used.

Comparative Example 3

In the present comparative example, DSP-213 was used as the nonionic surfactant and the other ingredients and their amounts were the same as those in Example 1.

TABLE 1

| Detergent Composition | | Example 1 | Example 2 |
|---|---|---|---|
| Alkali Metal Hydroxyl Compound | KOH | 2.5 g | 2.5 g |

TABLE 1-continued

| | | | |
|---|---|---|---|
| Nonionic Surfactant | CPE-212 | 7 g | 7 g |
| | DSP-213 | | |
| Anionic Surfactant | SAS60 | 2 g | |
| | SS-H | | 2 g |
| Chelating Agent | EDTA-4Na | 6 g | 6 g |
| Additive | p-TsONa | 6 g | 6 g |
| Pure Water | Pure Water | 76.5 g | 76.5 g |

| Detergent Composition | | Comparative Example 1 | Comparative Example 2 | Comparative Example 3 |
|---|---|---|---|---|
| Alkali Metal Hydroxyl Compound | KOH | 2.5 g | 2.5 g | 2.5 g |
| Nonionic Surfactant | CPE-212 | | | |
| | DSP-213 | | | 7 g |
| Anionic Surfactant | SAS60 | 2 g | | 2 g |
| | SS-H | | 2 g | |
| Chelating Agent | EDTA-4Na | 6 g | 6 g | 6 g |
| Additive | p-TsONa | 6 g | 6 g | 6 g |
| Pure Water | Pure Water | 84.5 g | 84.5 g | 76.5 g |

In the abovementioned Table 1, the nonionic surfactant, CPE-212 is represented as

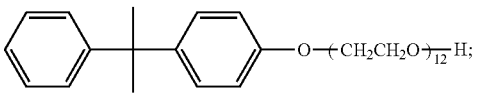

the nonionic surfactant, DSP-213 is represented as

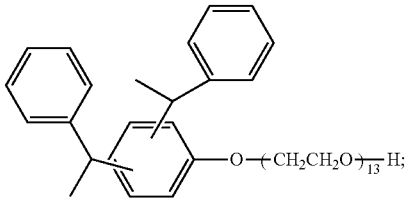

the anionic surfactant, Hostapur SAS 60 (Clariant) is represented as

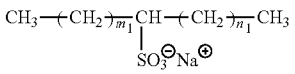

wherein $m_1$ and $n_1$ both are an integer, and $m_1+n_1$=10-14; the anionic surfactant, Pelex SS—H (Kao) is represented as

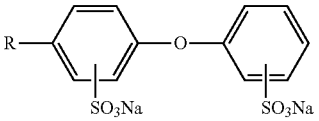

wherein R═$C_1$-$C_{12}$ alkyl group; EDTA-4Na is represented as

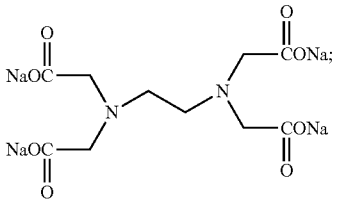

and p-TsONa (sodium p-toluenesulfonate) is represented as

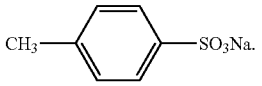

[Formulation of a Diluent of the Detergent Composition]

To 980 g of pour water, 20 g of the detergent compositions listed in Table 1 was added to form a detergent solution in total of 1000 g. In other words, the detergent compositions were diluted with water in 49 times the weight of the detergent composition. Subsequently, the resultant detergent solution was deposited in ELS Spin Developer (ELS706SA) to wash glass substrates, and the washed glass substrates were alkali-free glass substrates (100×100 mm) used for common flat-panel displays.

The washing device is ELS Spin Developer.

Device name: ELS Spin Developer—ELS706SA.

Operational summary: On ELS-706SA semiautomatic developer, the following steps were carried out, which included: manual arrangement of glass substrates, beginning of spinning stage, automatic fan-spitting-out of the detergent solution, automatic fan-spitting-out of DIW, and drying by spinning.

| Condition | |
|---|---|
| Detergent Spray Pressure | 0.5 kgf/cm$^2$ |
| Detergent Temperature | 25° C. |
| Detergent Time(s) | 30 |
| Spin (Detergent) | 150 rpm |
| Water Rinse Pressure | 1 kgf/cm$^2$ |
| Water Temperature | 25° C. |
| Water Rinse Time(s) | 30 |
| Spin (Rinse) | 150 rpm |
| Spin Dry | 3000 rpm/30 sec |
| Spin Dry | 5000 rpm/20 sec |

[Evaluation of Cleaning Performance]

Among various oil contaminations attaching to glass substrate surfaces, artificial contaminations, i.e. fingerprints (sebum) and general contaminations from transporters, i.e. machine oil (grease), were prepared on substrates to be cleaned. These substrates were used to estimate cleaning performance of the detergent composition with respect to oil contaminations.

Optical microscopes (200×, 10*20×) were used to carry out the estimation.

[Measurement and Calculation]

Dust removing ratio on glass (%)=[(The number of dust particles on the glass to be cleaned)−(The number of dust particles on the cleaned glass)]/(The number of dust particles on the glass to be cleaned)×100%

Fingerprint removing ratio on glass (%)=[(The number of fingerprints on the glass to be cleaned)−(The number of fingerprints on the cleaned glass)]/(The number of fingerprints on the glass to be cleaned)×100%

Machine oil removing ratio on glass (%)=[(The area of machine oil on the glass to be cleaned)−(The area of machine oil on the cleaned glass)]/(The area of machine oil on the glass to be cleaned)×100%

A contact angle meter was used to measure the contact angle of the cleaned glass. The results of the abovementioned calculation and measurement are listed in the following Table 2.

TABLE 2

| Estimation of cleaning performance | Example 1 | Example 2 | Comparative example 1 | Comparative example 2 | Comparative example 3 |
|---|---|---|---|---|---|
| Dust removing ratio on glass (%) | 98 | 98 | 90 | 85 | 90 |
| Fingerprint removing ratio on glass (%) | 100 | 100 | 95 | 90 | 95 |
| Fingerprint removing ratio on glass (%) | 100 | 100 | 100 | 95 | 100 |
| Contact angle of cleaned glass (degree) | 5.3 | 5.5 | 12.2 | 15.8 | 7.8 |

In accordance with Table 2, the detergent composition of the present invention can minimize contaminations on the cleaned substrates, and thus it can exhibit excellent cleaning performance.

In conclusion, in regard to the purpose, means, efficiency, technique, and research design, the characteristics of the present invention are absolutely different from those of prior arts. However, the above-mentioned examples are used only for illustration, and they should not be construed to limit the scope of the present invention as hereinafter claimed.

What is claimed is:

1. A detergent composition, comprising:

(A) an alkali metal hydroxyl compound in an amount of 0.1 to 20 parts by weight;

(B) a nonionic surfactant represented by the following formula (I) in an amount of 0.1 to 30 parts by weight:

(I)

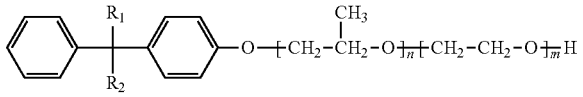

wherein $R_1$ is hydrogen or methyl; $R_2$ is hydrogen or methyl; n is an integer from 0 to 10; and m is an integer from 4 to 20;

(C) an anionic surfactant in an amount of 0.1 to 10 parts by weight;

(D) a chelating agent in an amount of 0.1 to 20 parts by weight;

(E) an additive in an amount of 0.1 to 20 parts by weight; and (F) water in an amount of remaining parts based on 100 parts by weight of the detergent composition.

2. The detergent composition as claimed in claim 1, wherein the alkali metal hydroxyl compound is at least one selected from the group consisting of NaOH, KOH, and a combination thereof.

3. The detergent composition as claimed in claim 1, wherein the anionic surfactant is at least one selected from the group consisting of

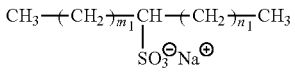

wherein $m_1$ and $n_1$ both are an integer, and $m_1+n_1$=10-14,

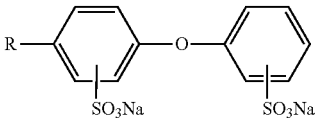

wherein R═$C_1$-$C_{12}$ alkyl group, and a combination thereof.

4. The detergent composition as claimed in claim 1, wherein the chelating agent is at least one selected from the group consisting of ethylenediaminetetraacetatic acid, ethylenediaminetetraacetate, nitrotriacetic acid, nitrotriacetate, and a combination thereof.

5. The detergent composition as claimed in claim 1, wherein the chelating agent is at least one selected from the group consisting of ethylenediaminetetraacetate, nitrotriacetate, and a combination thereof.

6. The detergent composition as claimed in claim 1, wherein the additive is selected from the group consisting of sodium p-toluenesulfonate, sodium xylenesulfonate, and a combination thereof.

* * * * *